US005757264A

United States Patent [19]

Petit

[11] Patent Number: 5,757,264

[45] Date of Patent: May 26, 1998

[54] ELECTRICALLY ADJUSTABLE RESISTOR STRUCTURE

[75] Inventor: Dominique A. Petit, Ponthierry, France

[73] Assignee: International Business Machines Corporation, Armonk, N.Y.

[21] Appl. No.: 718,107

[22] Filed: Sep. 18, 1996

[30] Foreign Application Priority Data

Dec. 20, 1995 [EP] European Pat. Off. ..... 95480179

[51] Int. Cl.[6] ..... H01C 10/00

[52] U.S. Cl. ..... 338/195; 29/620; 338/320; 257/529

[58] Field of Search ..... 338/195, 260, 338/320; 29/620; 341/121; 257/529, 530

[56] References Cited

U.S. PATENT DOCUMENTS

| | | | |
|---|---|---|---|
| 3,441,804 | 4/1969 | Klemmer | 317/101 |
| 3,930,304 | 1/1976 | Keller et al. | 338/195 |
| 3,983,528 | 9/1976 | King | 338/195 |
| 4,131,884 | 12/1978 | Comer | 341/121 |
| 4,138,671 | 2/1979 | Commer et al. | 341/121 |
| 4,228,418 | 10/1980 | Piedmont et al. | 338/195 |
| 4,238,839 | 12/1980 | Redfern et al. | 257/529 |
| 4,338,590 | 7/1982 | Connolly, Jr. et al. | 340/347 |
| 4,364,006 | 12/1982 | Makabe et al. | 323/353 |
| 4,488,144 | 12/1984 | Wollman | 340/347 |
| 4,709,225 | 11/1987 | Welland et al. | 341/121 |
| 4,777,471 | 10/1988 | Comer | 341/118 |
| 4,823,320 | 4/1989 | Smayling et al. | 365/185.1 |
| 4,862,136 | 8/1989 | Birkner | 338/195 |
| 4,906,966 | 3/1990 | Imamura et al. | 338/195 |
| 5,351,030 | 9/1994 | Kobayashi et al. | 338/295 |
| 5,382,922 | 1/1995 | Gersbach et al. | 331/1 A |
| 5,394,019 | 2/1995 | Audy | 327/525 |
| 5,418,738 | 5/1995 | Abadeer et al. | 257/530 |
| 5,446,407 | 8/1995 | Yamamoto | 257/529 |
| 5,493,148 | 2/1996 | Ohata et al. | 338/195 |

FOREIGN PATENT DOCUMENTS 0 327 078 A3 2/1989 European Pat. Off. .

OTHER PUBLICATIONS

Nickel, D.J., "Element Trimming Fusible Link", IBM Tech. Disc. Bul. V.26, No. 8, 1984, p. 4415.

*Primary Examiner*—Teresa J. Walberg
*Assistant Examiner*—Karl Easthom
*Attorney, Agent, or Firm*—H. Daniel Schnurmann

[57] ABSTRACT

A resistor structure which resistance value is electrically adjusted after fabrication by a tester during the test operation so that its equivalent resistance closely approximates a desired nominal value. The resistor structure includes a main resistor and a number of trimming resistors connected in parallel. Each trimming resistor can be connected in parallel to the main resistor independently of one another via a switch, typically a pass-gate NFET device, and serially connected therewith. The switch is enabled via a control line coupled to a binary storage cell. It includes a programmable fuse that can be electrically blown by the tester. Because the resistance value of the main resistor and trimming resistors changes as a result of fabrication process variations, the trimming resistors are designed so that no matter what the equivalent resistance value of the main resistor is, there exists an appropriate combination of trimming resistors to achieve the desired nominal value. This resistor structure is well suited for IC terminator chips.

13 Claims, 3 Drawing Sheets

ELECTRICALLY ADJUSTABLE RESISTOR STRUCTURE

FIELD OF THE INVENTION

The present invention relates to electrical resistors and, more particularly, to a resistor structure which value can be electrically altered after fabrication by a tester during the test operation, so that its equivalent resistance approximates a predetermined value.

BACKGROUND OF THE INVENTION

Semiconductor IC terminator chips have been extensively used to date for bus impedance matching. In particular, SCSI (Small Computer System Interface) buses which are well adapted to high speed data transfer between a CPU and an attachment (e.g., a hard-disk drive) include a predetermined number P of such termination resistors. In this case, the standard requirement is to put eighteen (P=18) termination resistors having a nominal value of 110Ω, with a tolerance target of about ±3%, on each terminator chip. For practical considerations, these termination resistors are generally built in polysilicon. Unfortunately, there is a non-negligible tolerance built in the sheet resistivity of polysilicon films which are produced in a semiconductor manufacturing line, and which is due to inevitable process variations. For instance, using a conventional 1.2 μm CMOS fabrication process, the polysilicon sheet resistivity PRS ranges from 21 to 29 Ω/sq (25 Ω/sq nominal) for wafers of different lots, i.e., with a resistivity tolerance of about ±16%. As a result, the value of standard termination resistors fabricated on different wafers of a same lot, according to this process, ranges from approximately 92Ω to about 128Ω. To get an acceptable final test yield, it is thus mandatory to trim every termination resistor to reach the desired nominal value of 110Ω, with a tolerance better than ±3%.

Up to now, the adjustment of the value of each termination resistor has been performed by complex equipment combining test and laser trimming capabilities. During test, a laser trimmer corrects the value of the resistor in real time. Basically, all the termination resistors emerging from a manufacturing line have a target value lower than the desired nominal value of 110Ω, and are more likely to be in the range of 90Ω. The tester performs a resistance measurement, and depending on the difference between the desired nominal value and the value that is measured, the laser beam tailors the termination resistor to increase its resistance. The trimming operation continues until the nominal resistance value of 110Ω is reached. The technique for trimming termination resistors has been determined to be very accurate. However, this approach is time consuming. Indeed, for any terminator chip such as the one described, the trimming operation must be repeated eighteen times. Moreover, this step is also expensive because sophisticated laser equipment (which includes precision optics, the laser system itself, etc.) is required to be associated to the tester. Consequently, prior art laser trimming techniques are adequate for only low volume expensive chips, but not for mass production of low cost chips.

Related patents include U.S. Pat. No. 4,364,006 to Takayoshi Makabi et al., issued Dec. 14, 1982; U.S. Pat. No. 4,488,144 to Wollman, issued Dec. 11, 1984; U.S. Pat. No. 3,441,804 to Klemmer, issued Apr. 29, 1969; U.S. Pat. No. 4,338,590 to Connolly Jr. at al., issued Jul. 6, 1982; and European Patent No. 0 327 078 to Imamura Kaoru et al., issued Aug. 9, 1989.

OBJECT OF THE INVENTION

It is therefore a primary object of the present invention to provide a resistor structure having a resistance value which can be electrically altered after fabrication by a tester during a test operation to reach the desired nominal value, and without requiring a costly and time consuming laser trimming step.

It is another object of the present invention to provide a resistor structure that includes a main resistor and a plurality of trimming resistors connected in parallel thereon, the equivalent resistance of which can be electrically adjusted after fabrication to reach the desired nominal value, although the resistance of the main resistor and trimming resistors may take a value comprised between a minimum value and a maximum value, due to process variations.

It is another object of the present invention to provide a resistor structure that includes a main resistor and a plurality of trimming resistors, wherein each trimming resistor can be electrically connected in parallel thereon, independently of one another.

It is another object of the present invention to provide a resistor structure that includes a main resistor and a plurality of trimming resistors connected in parallel thereon, wherein the resistance of the main resistor is equal to the minimum resistance value, as defined by the process specifications.

It is another object of the present invention to provide a resistor structure that includes a main resistor and a plurality of trimming resistors connected in parallel thereon, wherein the respective values of the trimming resistors are weighted in accordance to a geometric progression.

It is another object of the present invention to provide a resistor structure that includes a main resistor and a plurality of trimming resistors connected in parallel thereon, wherein the trimming resistors are designed such that when the resistance value of the main resistor is equal to a maximum value, all trimming resistors are connected to the main resistor in parallel, to provide the structure with an equivalent resistance which is approximately equal to a desired nominal value.

It is another object of the present invention to provide a resistor structure that includes a main resistor and a plurality of trimming resistors connected in parallel thereon, wherein the trimming resistors are designed such that when the resistance value of the main resistance is equal to a minimum, none of the trimming resistors are connected in parallel to the main resistor to provide the resistor structure with an equivalent resistance that is approximately equal to the desired nominal value.

It is another object of the present invention to provide a resistor structure that includes a main resistor and a plurality of trimming resistors connected in parallel thereon, wherein each trimming resistor is electrically connected in parallel to the main resistor by means of an enabling element, typically a switch that is serially connected therewith.

It is another object of the present invention to provide a resistor structure that includes a main resistor and a plurality of trimming resistors connected in parallel thereon, wherein the main resistor and the trimming resistors are made of polysilicon and the switch consists of a pass-gate NFET device.

It is still another object of the present invention to provide a resistor structure that includes a main resistor and a plurality of trimming resistors connected in parallel thereon, wherein each switch is controlled by a dedicated control or trimming line connected to a binary storage cell.

It is still another object of the present invention to provide a resistor structure that includes a main resistor and a plurality of trimming resistors connected in parallel thereon, wherein each binary storage cell includes a programmable fuse that can be electrically blown.

It is still another object of the present invention to provide a semiconductor IC terminator chip which includes a plurality of novel resistor structures, each consisting of a main resistor and a plurality of trimming resistors connected in parallel thereon, wherein each switch of the same rank (weight) in a resistor structure is controlled by a common dedicated control line connected to a binary storage cell.

It is still another further object of the present invention to provide a method for electrically adjusting the equivalent resistance value of a resistor structure consisting of a main resistor and a plurality of trimming resistors connected in parallel thereon, the resistance of which varies between a minimum value and a maximum value, due to process variation wherein the tester during a test operation selects the appropriate combination of trimming resistors.

It is still another further object of the present invention to provide a method for electrically adjusting the equivalent resistance value of a resistor structure consisting of a main resistor and a plurality of trimming resistors connected in parallel thereon, wherein each switch of the same rank (weight) in the structure is controlled by a common dedicated control line connected to a binary storage cell, each control line being activated by blowing an electrical fuse placed in the corresponding binary cell.

SUMMARY OF THE INVENTION

According to the teachings of the present invention, there is provided a resistor structure that includes a main resistor and a selected number N of trimming resistors connected in parallel. Each trimming resistor can be connected in parallel to the main resistor independently of each other through an enabling element, typically a switch, serially connected therewith. Each switch is activated and disabled via a dedicated control line. N control lines controlling the N switches are associated to the N trimming resistors. Preferably, the main resistors and the trimming resistors are made of polysilicon, whereas the switch consists of a pass-gate NFET device. The resistance of the main resistor (and trimming resistors as well) varies between a minimum value and a maximum value that are determined by the specifications, as a result of the resistivity variations due to the fabrication process. The main resistor is designed so that its minimum value is equal to the nominal value desired (e.g., its value is equal to 110Ω, which is the minimum for a termination resistor adapted to an SCSI bus when using a conventional CMOS process). The resistance values of the trimming resistors preferably varies according to a geometric progression, i.e., a binary weight (1, 2, 4, . . . ) assigned to each trimming resistor. Basically, these resistance values are determined according to the following rules. When the resistance of the main resistor is equal to a maximum value, all trimming resistors are connected in parallel to the main resistor by the tester, so that the resistor structure equivalent resistance decreases to the desired nominal value. Alternatively, when the resistance of the main resistor is equal to a minimum value (it is then equal to the desired nominal value by construction), none of the trimming resistors are connected in parallel to the main resistor. When the resistance of the main resistor is equal to some intermediate value, the tester determines which combination (among $2^N$) is the most adequate to reach the desired nominal value. The number N depends on the precision sought (typically N=3 or 4).

Still, according to another important feature of the present invention, each control line is connected to a binary storage cell which includes a fuse that can be programmed by the tester during the test operation. Blowing a fuse enables trimming the resistors to be connected in parallel to the main resistor.

This resistor structure is perfectly adapted to the fabrication of semiconductor integrated circuits (IC) terminator chips which includes P termination resistors. In this case, the resistor structure of the present invention takes the role of a termination resistor.

Still according to another further important feature of the present invention, a control line controls the corresponding P trimming resistors having the same rank or weight in each of the resistor structures, by enabling or disabling a switch associated therewith, so that there are N control lines and N binary storage cells for a plurality of P of resistor structures.

BRIEF DESCRIPTION OF THE DRAWINGS

The novel features believed to be characteristic of this invention are set forth in the appended claims. The invention itself, however, as well as other objects, aspects and advantages thereof, may be best understood by reference to the following detailed description of a preferred embodiment to be read in conjunction with the accompanying drawings.

DESCRIPTION OF THE PREFERRED EMBODIMENTS

The following description will be directed to the architecture of a terminator chip for a SCSI bus which includes P=18 termination resistors using conventional CMOS fabrication process techniques mentioned above. It has been previously mentioned that the polysilicon resistivity may substantially vary between wafers of different lots (±16%). As a result, although the desired nominal value is 110Ω, the real value of these termination resistors for wafers of different lots may range of 92–128Ω, due to process variations. However, it has been noticed that good resistivity tracking exists across a given wafer (±5%) and even better tracking across a given chip, e.g., lower than ±0.5%. Consequently, one may consider that resistors having the same geometry will have a substantially similar resistance on any chip of a given wafer. The present invention is based on this observation.

Figure 1:
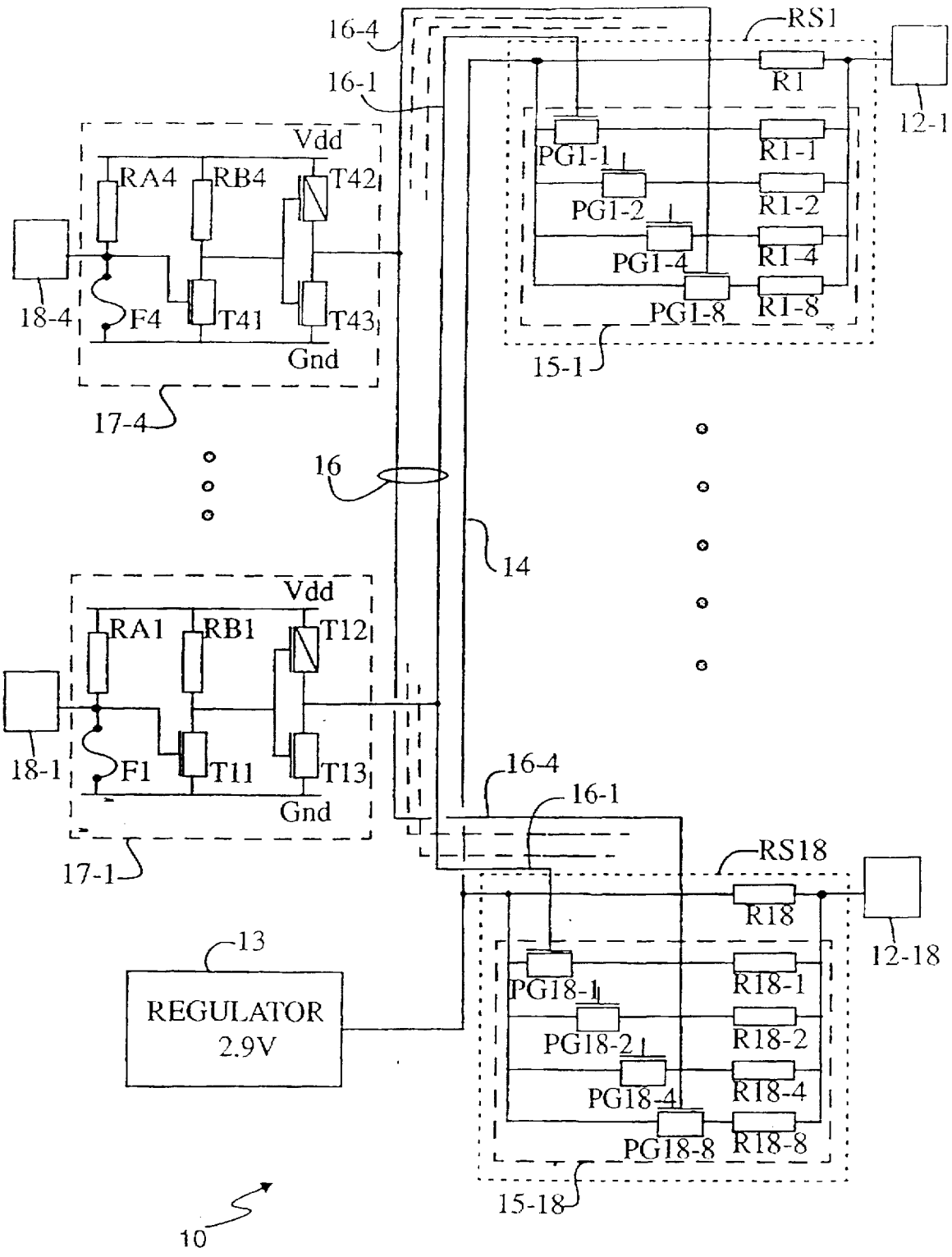
FIG. 1 shows a schematic circuit architecture of a semiconductor IC terminator chip adapted to a SCSI bus that includes eighteen termination resistors, each having the resistor structure of the present invention and the control circuitry thereof.

Referring to FIG. 1, there is shown the circuit diagram of a semiconductor IC terminator chip 10 that incorporates 18 resistors, according to the teachings of the present invention. The resistor structures are referenced RS1 to RS18 and incorporate, respectively, main resistors R1 to R18. It is to be noted that all the main resistors have the same value R1= . . . =R18=R (within ±0.5%). One end of each main resistor, e.g., R1, is connected to an output pad, e.g., 12-1, while the other end thereof is connected to a voltage regulator 13 via a common supply line 14. As a result, the voltage outputted by the regulator 13 is applied at one end of each main resistor R1 to R18.

According to a first feature of the present invention, an array of N branches is associated to each main resistor, each branch being comprised of a trimming resistor serially connected with an enabling element, typically a switch. This switch is physically implemented with a NFET device connected in a pass-gate configuration. By way of example, array 15-1 consisting of four branches connected in parallel is associated to the main resistor R1, each branch consisting in turn, of trimming resistors R1-1, R1-2, R1-4 and R1-8 (this notation emphasizes the geometric progression previously mentioned) and pass-gate NFET devices PG1-1, PG1-2, PG1-4 and PG1-8, respectively, serially connected therewith. In addition, trimming resistors of the same rank (or weight) in each array also have the same value, i.e., R1-1= . . . =R18-1. Within each array, the gates of pass-gate NFET devices of the same rank are attached to a common control or trimming line which, in turn, is connected to a binary storage cell. For instance, all pass-gate NFET devices PG1-1 to PG18-1 are connected via a trimming line 16-1 to the output of storage cell 17-1. Thus, there are four (N=4) trimming lines 16-1 to 16-4 (all together forming bus 16) connected to storage cells 17-1 to 17-4, respectively. Note that the number N of trimming resistors is equal to 4; although its real number depends on the specific application. All storage cells have the same construction. For instance, storage cell 17-1 first comprises a resistor RA1 and an electrical fuse F1 that are connected in series between a first supply voltage (Vdd) and a second supply voltage (Gnd). The common node formed therebetween, referred to as the input node, is connected to an input pad 18-1 on the one hand, and to the gate electrode of a NFET device T11, on the other. NFET device T11 is connected in series to a second resistor RB1 between the first and second power supply voltages Vdd and Gnd. Finally, the common node between NFET device T11 and resistor RB1 is connected to the commom gate of an output inverter comprised of a pair of complementary FET devices T12 and T13, still biased between Vdd and Gnd. The common output node of the output inverter of storage cell 17-1 is connected to trimming line 16-1.

According to another feature of the present invention, the value of the main resistor R is set such that its resistance value is equal to the desired nominal value (e.g. 110Ω) when the polysilicon sheet resistivity is at the low end of the specification (i.e. PRS=21 Ω/sq). In this case, the main resistor will remain alone after fabrication, and without any trimming resistors connected in parallel thereon.

The number N of trimming resistors is determined by the specific application and the precision that is sought. The criteria for determining the resistance value of each trimming resistor will now be given. For sake of simplicity, they are designed to have a resistance value in a 1, ½, ¼, ⅛, . . . geometric progression to assign a binary weight to each of them. For instance, if R1-1 is the resistor having a weight 1, the value of R1-2 will be ½ the value of R1-1, . . . , etc.

Using the conventional CMOS process mentioned above, at nominal centering, the value of the main resistor is equal to 131Ω (PRS=25 Ω/sq). If the value of the main resistor after fabrication is at the maximum value, i.e., 152Ω, at the high end of the polysilicon sheet resistivity specification (i.e., PRS=29 Ω/sq), all the trimming resistors are connected in parallel to the main resistor to reach an equivalent resistance equal to the desired nominal value. As a result, regardless of the resistance value of the main resistor between the minimum value and the maximum values, there exists a combination (one of $2^N$) of trimming resistors to reach the desired nominal value. Since the main resistors have all the value R, with a precision of about ±0.5%, the same combination of trimming resistors applies to each resistor structure RS1 to RS18. However, an implementation requiring P×N control lines for an individual personalization of the P×N trimming resistors could be theoretically envisioned.

Hereinafter, a detailed method for calculating the resistance values of the main and four trimming resistors will be given, for a case in which all the main and trimming resistors are made of polysilicon. The same value given hereinbefore of, e.g., the polysilicon sheet resistivity PRS of approximately 25±4 Ω/sq is used.

Figure 2:
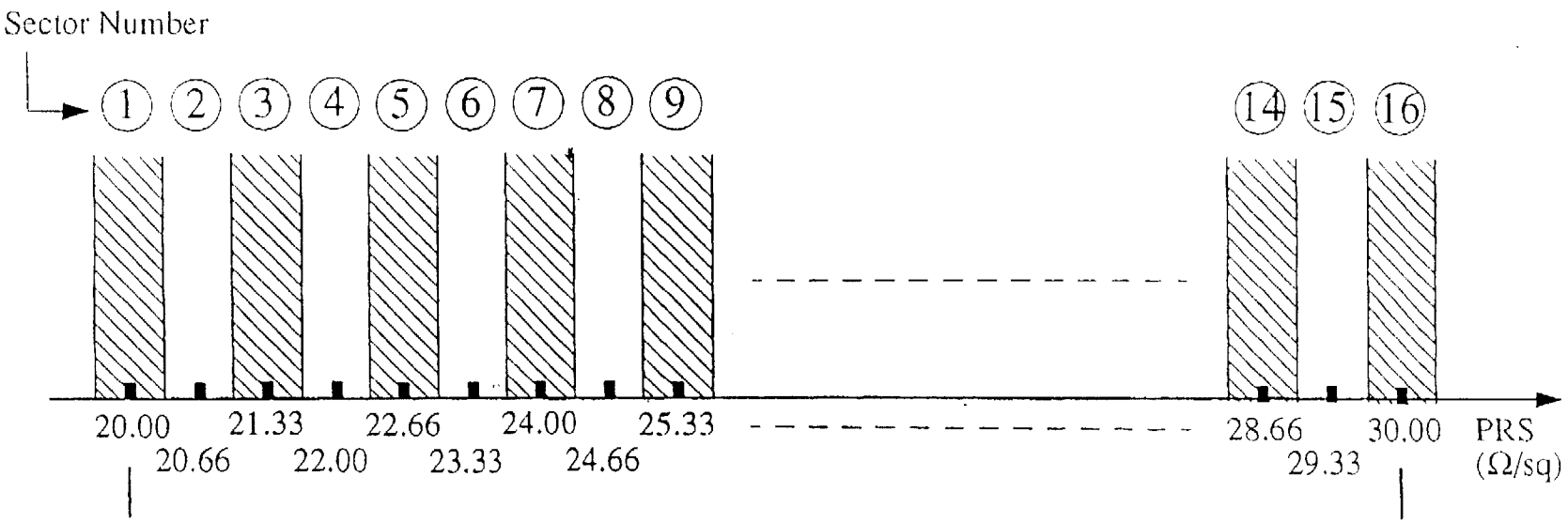
FIG. 2 is a graph depicting the polysilicon sheet resistivity variations that result from a conventional CMOS manufacturing process when divided in sixteen ($2^4$) sectors to cover the whole range thereof.

First, we will consider that this value varies from 20 to 30 Ω/sq to add a guardband. Therefore, the main resistor will be designed so that its resistance value is equal to 110Ω when PRS=20 Ω/sq. This resistance value will thus increase to 165Ω when PRS is equal to the maximum value, i.e., 30 Ω/sq. Next, the 20–30 Ω/sq PRS specification range is split into sixteen ($2^N$) bands or sectors, as illustrated in FIG. 2.

To make calculations easier, since the main resistor value has been made equal to 110Ω as explained above, a length L=110 μm has been chosen. In this case, the relation between the equivalent resistance Req of the resistor structure, the length L and the equivalent width Weq of the main resistor structure is given by:

$$Weq \text{ (in } \mu\text{m)}=(PRS\times L)/Req=PRS \text{ (in } \Omega\text{/sq)}.$$

Therefore the width of the main resistor is equal to 20 μm. This relation enables to calculate the value of the resistor structure equivalent resistance width Weq, since it is equal to PRS. By way of example, when PRS=20.66 Ω/sq (see sector 2 in FIG. 2), the width Weq of this equivalent resistor Req becomes 20.66 μm. In turn, the width of the trimming resistor of weight 1 labelled R1-1 (or W1), i.e., the one which with the greatest value and, thus, the one producing the least significant correction when connected in parallel on the main resistor, can be easily determined. The width of trimming resistor R1-1=20.66 μm−20 μm=0.66 μm.

The TABLE below describes in more details the splitting of the PRS specification range into 16 sectors, and provides for each case the value of the main resistor when alone. It further indicates which trimming resistor or combination of trimming resistors are to be connected in parallel to the main resistor to reach the desired nominal value of 110Ω. It is also used to determine the respective widths of trimming resistors R1-1 (W1), R1-2 (W2), R1-3 (W3) and R1-4 (W4).

TABLE

| Sect. numb. | 1 | 2 | 3 | 4 | 5 | . . . | 16 |
|---|---|---|---|---|---|---|---|
| PRS (Ω/sq) (cent. val.) | 20.00 | 20.66 | 21.33 | 22.00 | 22.66 | . . . | 30.00 |
| Main resist. (alone) | 110.0 | 113.6 | 117.3 | 121.0 | 124.6 | . . . | 165.0 |
| Weq | 20.00 | 20.66 | 21.33 | 22.00 | 22.66 | . . . | 30.00 |
| Combin. of trim. resist. | none | W1 | W2 | W1 + W2 | W3 | . . . | all |

In summary, the respective dimensions of the trimming resistors based on the TABLE above are:

| | |
|---|---|
| R1-1 (W1) | weight 1: 110 μm long and 0.66 μm wide |
| R1-2 (W2) | weight 2: 110 μm long and 1.33 μm wide |
| R1-3 (W3) | weight 4: 110 μm long and 2.66 μm wide |
| R1-4 (W4) | weight 8: 110 μm long and 5.33 μm wide |

For a nominal PRS value, i.e., 25 Ω/sq, they respectively correspond to the following resistance values:

| | |
|---|---|
| R1-1 (W1) | weight 1: 25 × 110/0.66 = 4125 Ω |
| R1-2 (W2) | weight 2: 25 × 110/1.33 = 2062 Ω |
| R1-3 (W3) | weight 4: 25 × 110/2.66 = 1031 Ω |
| R1-4 (W4) | weight 8: 25 × 110/5.33 = 516 Ω |

Figure 3:
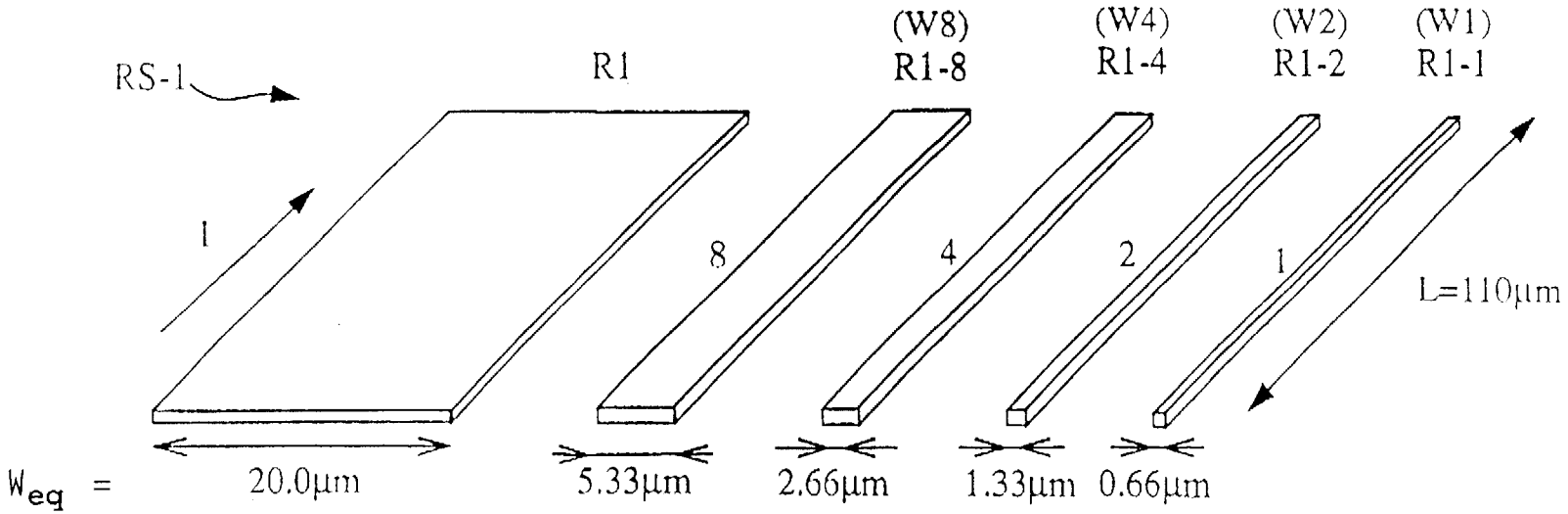
FIG. 3 shows a physical implementation of the main and trimming resistors, all made of polysilicon, for integration in a semiconductor IC terminator chip for a SCSI bus, according to a conventional CMOS manufacturing process.

When PRS is at a minimum, the main resistor value of 110Ω is left unchanged. When PRS is at a maximum, all four trimming resistors are connected in parallel to the main resistor to bring its value down from 165Ω to 110Ω. Finally, when PRS has an intermediate value, a combination of the four trimming resistors according to the above TABLE is connected in parallel thereon. For instance, if the measured value of the main resistor is 121Ω, it will require trimming resistors having a weight of W1 and W2 to be attached to it. For the resistor structure RS1, the relative physical dimensions of main resistor R1 with its four associated trimming resistors R1-1 to R1-8 are shown in FIG. 3.

The above calculations are based on the assumption that, for simplicity sake, a pass-gate NFET offers negligible ON-resistance (Ron) when compared to the trimming resistor value. However, in practice, the ON-resistance which depends on the size and type of the switch being used, should be taken into account for greater accuracy. For instance, still with the conventional CMOS technology mentioned above, the ON-resistance of pass-gate NFET device PG1-1 is set equal to about ¼ of its theoretical value. In reality, R1-1 is made equal to about 3000Ω, with the PG-1 resistance equal to 1000Ω. Many wafers manufactured according to a conventional CMOS process and chips diced therefrom, have demonstrated that all termination resistors, after adjustment, were equal to 110Ω, with a precision of about ±2%.

Alternate techniques may be envisioned for selecting the desired pass-gate NFET devices. According to an important aspect of the present invention, programmable (i.e., electrically blown) fuses can be used to activate the control lines which, in turn, enable or disable the trimming resistors. The fuse blowing operation can be done in two ways. A first method consists in measuring a sampling of the main resistors without connecting any trimming resistors and, knowing their average value, blowing the adequate fuses to reach the target value, according to the above TABLE, i.e., the desired nominal value. The second method, particularly applicable to specially designed fuses, consists in simulating with the tester some combination of trimming resistors without physically blowing the fuses, and then selecting the one combination giving the best result. The second method takes somewhat longer, but it allows for more precise results. These two methods will be now described in more detail.

It has been shown that on any given chip, the eighteen main resistors (and corresponding trimming resistors as well) have substantially the same value (±0.5%). Hence, to adjust the eighteen main resistors for a given chip, it suffices to measure one main resistor and determine which combination of trimming resistors will be used. However, still pursuant to the first method, the tester starts by measuring the value of a few main resistors and computes their average (or center) value for increased precision. Then, the tester compares this average value to the resistance values corresponding to the boundaries of the eighteen sectors of the PRS specification shown in the above TABLE and in FIG. 2. Once the correct sector has been determined, the tester knows which fuses are to be blown in order to activate the correct set of trimming lines that select the desired combination of trimming resistors. As a result, once the best combination has been determined, it is possible to enable all the 4×18 pass-gate NFET devices by using only four trimming lines. Their activation dependents upon the binary state of four storage cells.

Measuring the main resistors is possible when no fuses have been blown or when one applies low voltage levels to all input pads. In the present case, all the 4×18 pass-gate NFET devices are off so that none of the trimming resistors are connected. To blow a fuse, a 10 V pulse is applied at the input pad which is attached to the fuse in question (e.g., input pad 18-1 for fuse F1). The fuse resistance being approximately 80Ω, the current spike that is created in the fuse is of the order of 100–120 mA. The thermal effect that is caused vaporizes the fuse structure, leaving no residue.

To introduce the second method, it must be said that to neatly blow a fuse, a pulse having an amplitude of at least 7V must be applied. If the pulse amplitude varies between 5 and 7 V, the fuse may only be partially destroyed, and the reliability of the fuse blow cannot be guaranteed. If the pulse is below 3 V, then the fuse just heats up without causing damage. The principle of this second method, therefore, consists in applying a 2.5 V level on the selected fuses so that the circuitry lying behind the fuse will consider this voltage as a high logic level, just as if the fuses were blown. This allows the tester to measure the resistance of the main resistor with various combinations of the trimming resistors, and choose the one giving the best results.

The input pads 18-1 to 18-4 that control all the pass-gate NFET devices are normally at a low voltage since fuses attach them to Gnd. When calculations show that a trimming line must be raised to a high voltage to enable the corresponding set of pass-gate NFET devices, the corresponding fuse structure is blown. The potential of the input pad that is connected to this fuse is pulled up, which in turn causes the trimming line to be activated (set high) by two successive inverters (e.g., T11, RB1 and T12, T13 in binary cell 17-1).

Depending on the optimum combination determined by the tester, adequate fuses will be blown to set the chosen combination. Unlike prior art solutions, wherein fuses are generally blown by a laser beam, in this case, they are blown by current spikes generated by the tester. The key advantage of electrically blown fuses over laser blown is that a single pass operation suffices. By dispensing from laser tools, better chip quality ensues, since it is probed only once instead of twice (in case of pre/post fuse tests).

Fuses that can be electrically blown are widely used in microelectronics. They usually are made of metal. Since the metal is naked in the fuse window to allow for easy vaporization, remaining fuses are subject to corrosion. Polysilicon, on the other hand, is not normally subject to corrosion. Moreover, to protect it, it should be covered by a boro-phospho-silicate glass (BPSG) layer. Thus, electrically blown polysilicon fuses are preferred in the fabrication of terminator chips to ensure that the fuses that were not programmed remain conductive.

This invention offers several major advantages in terms of cost, accuracy, ease of use and reliability. There is no longer a need for a complex and costly laser trimming apparatus.

The tester performs all the operations: it determines the best trimming combination, programs the fuses, and checks that the termination resistors exhibit the desired resistance value after programming the fuses. In addition, as previously mentioned, the tolerance of the post-fuse resistance of a resistor structure is close to 2%, which results in a precision of 0.5% for on-chip tracking, and 1.5% for trimming resolution. Since the search for the best combination, fuse blowing, and post-fuse test are all performed in a single operation, the test step becomes fast (below three seconds) and easy. Also, because no wafer transfer between various pieces of equipments is required, the overall test/fuse/test turn-around-time (TAT), likewise, also improves. Finally, the present technique is highly reliable because the fuses are cleanly blown, with no risk that residues remain or that an unblown fuse becomes corroded.These advantages are obtained at the cost of integrating the four storage cells with the input pads to allow the tester to access the fuses, eighteen arrays of four small trimming resistors and the associated pass-gate NFET devices. Note that these input pads are not connected at the module level.While the invention has been described with reference to preferred embodiments, it will be understood by those skilled in the art that many variations in form and detail may be made therein without departing from the spirit and scope of the invention. For instance, the number N of trimming resistors may differ to meet any desired precision. Alternatively, three trimming resistors per trimming array (with thus three storage cells) offering eight combinations (instead of 16, when N=4) may prove to be sufficient for many applications.

What is claimed is: 1. A resistor structure comprising:

a plurality of main resistors, each of said main resistors having a resistance value which can be electrically altered;

a plurality of resistor arrays, each of said resistor arrays comprising a plurality N of trimming resistors connected in parallel to each of said main resistors, said trimming resistors having each a fixed weight value;

a switching device serially connected to each of said N trimming resistors; and

N binary storage cells provided each with a programmable fuse, each of said binary storage cells having an output line to control all of said trimming resistors having the same fixed weight value in said resistor arrays, said control lines enabling and disabling at least one of said switching devices to selectively incorporate selected ones of said trimming resistors into said resistor array connected to each of said main resistors to electrically alter the resistance value of at least one main resistor. 2. The resistor structure of claim 1 wherein the respective resistance value of said trimming resistor are weighted in a geometric progression.3. The resistor structure of claim 1, wherein the equivalent resistance value of said resistor structure is electrically altered to approximate a predetermined nominal resistance value by activating a subset of said programmable fuses. 4. The resistor structure of claim 1, wherein said switching device is a pass-gate NFET device.5. The resistor structure of claim 1, wherein said main resistor and said trimming resistors are made of polysilicon. 6. The resistor structure of claim 3, further comprising main resistors having a measured resistance, and each of said resistor arrays having:

all said trimming resistors connected to said main resistor when said measured resistance of said main resistor is equal to a maximum value, thereby making the equivalent resistance approximately equal to a predetermined nominal value, none of said trimming resistors connected to said main resistor when said measured resistance of said main resistor is equal to a minimum value, and a subset of said trimming resistors connected to said main resistor when said measured resistance value of said main resistor falls between said maximum value and said minimum value. 7. The resistor structure of claim 6, wherein said programmable fuses enable and disable corresponding ones of said switching devices to place a selected number of said trimming resistors in parallel with each of said, main resistors.8. The resistor structure of 5, wherein the sheet resistivity range of said polysilicon is divided into $2^N$ sectors, and wherein a combination of said trimming resistors is assigned to each of said sectors.9. A method for electrically adjusting the equivalent resistance value of a resistor structure comprising the steps of:

providing a main resistor;

attaching to said main resistor a plurality of N trimming resistors connected in parallel and forming an array thereon, each of said trimming resistors having a predetermined weight value;

serially connecting a switching device to each of said trimming resistors; and providing N binary storage cells having each a programmable fuse, each of said binary storage cells controlling all said trimming resistors having the same weight by enabling and disabling corresponding ones of said switching devices. 10. The method of claim 9 further comprising the steps of:

designing said main resistor to have its minimum resistance value equal to the predetermined nominal resistance value;

connecting in parallel said trimming resistors to said main resistor when said equivalent resistance of said resistor structure is at a maximum value;

disconnecting said trimming resistors from said main resistor when said equivalent resistance of said resistor structure is at a minimum value;

connecting in parallel a combination of said trimming resistors to said main resistor when said equivalent resistance of said resistor structure is between said minimum and said maximum value;

measuring the resistance value of said main resistor;

determining a combination of said trimming resistors to approximate the desired nominal value; and activating enabling means to connect in parallel said combination of trimming resistors to said main resistor.11. The method of claim 9 further comprising the step of measuring said main resistor and placing one of said arrays in parallel with said main resistor, said one array having a number of said trimming resistors which in combination with said main resistor matches said equivalent resistance of said main resistor based on said measurement of said main resistor.12. The method of claim 9 further comprising the step of activating said control lines to enable and disable a corresponding number of said switching devices to activate a subset of said trimming resistors.13. The method of claim 9 further comprising the step of blowing said programmable fuses by a current spike.

* * * * *